US008628316B2

(12) United States Patent
Stover et al.

(10) Patent No.: US 8,628,316 B2
(45) **Date of Patent: *Jan. 14, 2014**

(54) COMPRESSOR HAVING CAPACITY MODULATION SYSTEM

(75) Inventors: Robert C. Stover, Versailles, OH (US); Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 150 days.

This patent is subject to a terminal disclaimer.

(21) Appl. No.: 13/167,192

(22) Filed: Jun. 23, 2011

(65) Prior Publication Data

US 2011/0256009 A1 Oct. 20, 2011

Related U.S. Application Data

(63) Continuation of application No. 12/474,633, filed on May 29, 2009, now Pat. No. 7,976,295.

(60) Provisional application No. 61/057,448, filed on May 30, 2008.

(51) Int. Cl.
*F04C 18/02* (2006.01)
*F04C 2/00* (2006.01)

(52) U.S. Cl.
USPC ..... 418/55.5; 418/15; 418/55.1; 418/57; 418/180; 417/299; 417/308; 417/310

(58) Field of Classification Search
USPC ..... 418/15, 55.1–55.6, 57, 180, 270; 417/299, 307, 308, 310, 440
See application file for complete search history.

(56) References Cited

U.S. PATENT DOCUMENTS 4,382,370 A 5/1983 Suefuji et al.
4,383,805 A 5/1983 Teegarden et al.

(Continued)

FOREIGN PATENT DOCUMENTS

JP 03081588 A 4/1991
JP 05001677 A 1/1993

(Continued)

OTHER PUBLICATIONS

International Search Report dated Jan. 21, 2010 regarding International Application No. PCT/US2009/045638, 3 pages.

(Continued)

*Primary Examiner* — Theresa Trieu
(74) *Attorney, Agent, or Firm* — Harness, Dickey & Pierce, P.L.C.

(57) ABSTRACT

A compressor includes a housing, a first scroll member, a second scroll member and a modulation assembly. The first scroll member includes a first end plate having a discharge passage, a first spiral wrap, and a first aperture extending through the first end plate. The second scroll member includes a second end plate having a second spiral wrap extending therefrom and meshingly engaged with the first spiral wrap to form a series of pockets. The first aperture is in communication with a first of the pockets. The modulation assembly is in communication with the first aperture and is operable in a full capacity mode where the first aperture is isolated from a suction pressure region providing full capacity operation and in a reduced capacity mode where the first aperture is in communication with the suction pressure region providing approximately zero capacity operation.

28 Claims, 4 Drawing Sheets

(56) References Cited

U.S. PATENT DOCUMENTS

| | | | | |
|---|---|---|---|---|
| 4,431,388 | A | 2/1984 | Eber et al. | |
| 4,497,615 | A | 2/1985 | Griffith | |
| 4,669,962 | A | 6/1987 | Mizuno et al. | |
| 4,774,816 | A | 10/1988 | Uchikawa et al. | |
| 4,818,195 | A | 4/1989 | Murayama et al. | |
| 4,904,165 | A | 2/1990 | Fraser, Jr. et al. | |
| 4,940,395 | A | 7/1990 | Yamamoto et al. | |
| 5,074,760 | A | 12/1991 | Hirooka et al. | |
| 5,156,539 | A * | 10/1992 | Anderson et al. | 418/55.5 |
| RE34,148 | E | 12/1992 | Terauchi et al. | |
| 5,169,294 | A | 12/1992 | Barito | |
| 5,192,195 | A | 3/1993 | Iio et al. | |
| 5,193,987 | A | 3/1993 | Iio et al. | |
| 5,240,389 | A | 8/1993 | Oikawa et al. | |
| 5,336,058 | A | 8/1994 | Yokoyama | |
| 5,356,271 | A | 10/1994 | Miura et al. | |
| 5,451,146 | A | 9/1995 | Inagaki et al. | |
| 5,551,846 | A | 9/1996 | Taylor et al. | |
| 5,557,897 | A | 9/1996 | Kranz et al. | |
| 5,562,426 | A | 10/1996 | Watanabe et al. | |
| 5,577,897 | A | 11/1996 | Inagaki et al. | |
| 5,607,288 | A | 3/1997 | Wallis et al. | |
| 5,639,225 | A | 6/1997 | Matsuda et al. | |
| 5,674,058 | A | 10/1997 | Matsuda et al. | |
| 5,678,985 | A | 10/1997 | Brooke et al. | |
| 5,855,475 | A | 1/1999 | Fujio et al. | |
| 5,885,063 | A | 3/1999 | Makino et al. | |
| 5,993,171 | A | 11/1999 | Higashiyama | |
| 5,993,177 | A | 11/1999 | Terauchi et al. | |
| 6,077,057 | A | 6/2000 | Hugenroth et al. | |
| 6,086,335 | A * | 7/2000 | Bass et al. | 418/55.5 |
| 6,102,671 | A | 8/2000 | Yamamoto et al. | |
| 6,123,517 | A | 9/2000 | Brooke et al. | |
| 6,132,179 | A | 10/2000 | Higashiyama | |
| 6,164,940 | A | 12/2000 | Terauchi et al. | |
| 6,176,686 | B1 | 1/2001 | Wallis et al. | |
| 6,210,120 | B1 | 4/2001 | Hugenroth et al. | |
| 6,213,731 | B1 | 4/2001 | Doepker et al. | |
| 6,231,316 | B1 | 5/2001 | Wakisaka et al. | |
| 6,273,691 | B1 | 8/2001 | Morimoto et al. | |
| 6,293,767 | B1 | 9/2001 | Bass | |
| 6,350,111 | B1 | 2/2002 | Perevozchikov et al. | |
| 6,412,293 | B1 | 7/2002 | Pham et al. | |
| 6,413,058 | B1 | 7/2002 | Williams et al. | |
| 6,454,551 | B2 | 9/2002 | Kuroki et al. | |
| 6,464,481 | B2 | 10/2002 | Tsubai et al. | |
| 6,506,036 | B2 | 1/2003 | Tsubai et al. | |
| 6,544,016 | B2 | 4/2003 | Gennami et al. | |
| 6,558,143 | B2 | 5/2003 | Nakajima et al. | |
| 6,589,035 | B1 | 7/2003 | Tsubono et al. | |
| 6,769,888 | B2 | 8/2004 | Tsubono et al. | |
| 6,821,092 | B1 | 11/2004 | Gehret et al. | |
| 6,881,046 | B2 | 4/2005 | Shibamoto et al. | |
| 6,884,042 | B2 | 4/2005 | Zili et al. | |
| 6,984,114 | B2 | 1/2006 | Zili et al. | |
| 7,118,358 | B2 | 10/2006 | Tsubono et al. | |
| 7,137,796 | B2 | 11/2006 | Tsubono et al. | |
| 7,229,261 | B2 | 6/2007 | Morimoto et al. | |
| 7,326,039 | B2 | 2/2008 | Kim et al. | |
| 7,344,365 | B2 | 3/2008 | Takeuchi et al. | |
| 7,354,259 | B2 | 4/2008 | Tsubono et al. | |
| RE40,344 | E | 5/2008 | Perevozchikov et al. | |
| 7,404,706 | B2 | 7/2008 | Ishikawa et al. | |
| 7,513,753 | B2 | 4/2009 | Shin et al. | |
| 7,547,202 | B2 | 6/2009 | Knapke | |
| 7,771,178 | B2 | 8/2010 | Perevozchikov et al. | |
| 7,967,582 | B2 | 6/2011 | Akei et al. | |
| 7,967,583 | B2 | 6/2011 | Stover et al. | |
| 7,972,125 | B2 | 7/2011 | Stover et al. | |
| 7,976,295 | B2 * | 7/2011 | Stover et al. | 418/55.5 |
| 7,976,296 | B2 | 7/2011 | Stover et al. | |
| 7,988,433 | B2 | 8/2011 | Akei et al. | |
| 7,988,434 | B2 | 8/2011 | Stover et al. | |
| 8,313,318 | B2 * | 11/2012 | Stover et al. | 418/55.5 |
| 2001/0010800 | A1 | 8/2001 | Kohsokabe et al. | |
| 2002/0039540 | A1 | 4/2002 | Kuroki et al. | |
| 2004/0071571 | A1 | 4/2004 | Uchida et al. | |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0053507 | A1 | 3/2005 | Takeuchi et al. | |
| 2007/0092390 | A1 | 4/2007 | Ignatiev et al. | |
| 2007/0237664 | A1 | 10/2007 | Joo et al. | |
| 2008/0159892 | A1 | 7/2008 | Huang et al. | |
| 2009/0068048 | A1 | 3/2009 | Stover et al. | |
| 2009/0071183 | A1 | 3/2009 | Stover et al. | |
| 2009/0196781 | A1 | 8/2009 | Kiem et al. | |
| 2009/0297377 | A1 | 12/2009 | Stover et al. | |
| 2009/0297378 | A1 | 12/2009 | Stover et al. | |
| 2009/0297379 | A1 | 12/2009 | Stover et al. | |
| 2009/0297380 | A1 | 12/2009 | Stover et al. | |
| 2010/0111741 | A1 | 5/2010 | Chikano et al. | |
| 2010/0135836 | A1 | 6/2010 | Stover et al. | |
| 2010/0158731 | A1 | 6/2010 | Akei et al. | |
| 2010/0254841 | A1 | 10/2010 | Akei et al. | |
| 2010/0300659 | A1 | 12/2010 | Stover et al. | |
| 2010/0303659 | A1 | 12/2010 | Stover et al. | |
| 2011/0033328 | A1 | 2/2011 | Stover et al. | |
| 2011/0103988 | A1 | 5/2011 | Stover et al. | |
| 2011/0256009 | A1 | 10/2011 | Stover et al. | |

FOREIGN PATENT DOCUMENTS

| | | | |
|---|---|---|---|
| JP | 2000161263 | A | 6/2000 |
| JP | 2007154761 | A | 6/2007 |
| WO | 2009155109 | | 12/2009 |

OTHER PUBLICATIONS

Written Opinion of the International Searchinig Authority dated Jan. 21, 2010 regarding Internatinoal Application No. PCT/US2009/045638, 3 pages.

International Search Report dated Jan. 4, 2010 regarding International Application No. PCT/US2009/045666.

International Search Report dated Jan. 8, 2010 regarding International Application No. PCT/US2009/045665.

International Search Report dated Jan. 29, 2010 regarding International Application No. PCT/US2009/045647.

Written Opinion of the International Searching Authority dated Jan. 29, 2010 regarding International Application No. PCT/US2009/045647.

International Search Report dated May 31, 2010 regarding International Application No. PCT/US2009/066551, 3 pgs.

Written Opinion of the International Searching Authority dated May 31, 2010 regarding International Application No. PCT/US2009/066551, 3 pgs.

International Search Report regarding Application No. PCT/US2010/036586, mailed Jan. 17, 2011.

Written Opinion of the International Searching Authority dated Jan. 4, 2010 regarding Inernational Application No. PCT/US2009/045666.

Written Opinion of the International Search Authority dated Jan. 8, 2010 regarding International Application No. PCT/US2009/045665.

Written Opinion of the International Searching Authority regarding Application No. PCT/US2010/036586, mailed Jan. 17, 2011.

Non-Final Office Action for U.S. Appl. No. 12/474,806, mailed Jun. 18, 2012.

Non-Final Office Action for U.S. Appl. No. 12/909,303, mailed Jan. 10, 2013.

International Search Report dated Jan. 14, 2010 regarding International Application No. PCT/US2009/045672.

Written Opinion of the International Searching Authority dated Jan. 14, 2010 regarding International Application No. PCT/US2009/045672.

Non-Final Office Action for U.S. Appl. No. 13/367,950, mailed Jan. 11, 2013.

First Office Action regarding Chinese Patent Application No. 2009801269614, dated Feb. 5, 2013. English translation provided by Unitalen Attorneys at Law.

* cited by examiner

COMPRESSOR HAVING CAPACITY MODULATION SYSTEM

CROSS-REFERENCE TO RELATED APPLICATIONS

This application is a continuation of U.S. patent application Ser. No. 12/474,633 filed on May 29, 2009 which claims the benefit of U.S. Provisional Application No. 61/057,448, filed on May 30, 2008. The entire disclosures of each of the above applications are incorporated herein by reference.

FIELD

The present disclosure relates to compressors, and more specifically to compressors having capacity modulation systems.

BACKGROUND

This section provides background information related to the present disclosure which is not necessarily prior art.

Scroll compressors include a variety of capacity modulation mechanisms to vary operating capacity of a compressor. The capacity modulation mechanisms may include fluid passages extending through a scroll member to selectively provide fluid communication between compression pockets and another pressure region of the compressor.

SUMMARY

This section provides a general summary of the disclosure, and is not a comprehensive disclosure of its full scope or all of its features.

A compressor may include a housing, a first scroll member, a second scroll member and a modulation assembly. The first scroll member may include a first axial end surface, may be supported within the housing and may include a first end plate having a discharge passage, a first spiral wrap extending from a first side of the first end plate, and a first aperture extending through the first end plate. The second scroll member may include a second axial end surface, may be supported within the housing and may include a second end plate having a second spiral wrap extending therefrom and meshingly engaged with the first spiral wrap to form a series of pockets. The first aperture may be in communication with a first of the pockets. The modulation assembly may be located within the housing and may be in communication with the first aperture. The modulation assembly may be operable in a full capacity mode where the first aperture is isolated from a suction pressure region of the compressor to operate the compressor at a full capacity during orbital displacement of the second scroll member relative to the first scroll member and in a reduced capacity mode where the first aperture is in communication with the suction pressure region to operate the compressor at approximately zero capacity during orbital displacement of the second scroll member relative to the first scroll member while the first axial end surface contacts the second scroll member or the second axial end surface contacts the first scroll member.

The first spiral wrap may contact the second end plate during orbital displacement of the second scroll member relative to the first scroll member and compressor operation at approximately zero capacity. The second spiral wrap may contact the first end plate during orbital displacement of the second scroll member relative to the first scroll member and compressor operation at approximately zero capacity.

The series of pockets may include a suction pocket, a discharge pocket and intermediate pockets. The first end plate may define a plurality of apertures including the first aperture and in communication with the intermediate pockets. Each of the intermediate pockets may be in communication with one of the apertures. The reduced capacity mode may include each of the apertures being in communication with the suction pressure region to provide compressor operation at approximately zero capacity. The compressor may additionally include a first chamber located on a second side of the first end plate and in communication with the plurality of apertures. The modulation assembly may include a piston disposed within the first chamber and axially displaceable between first and second positions. The piston may isolate the plurality of apertures from communication with the suction pressure region when in the first position and may provide communication between the plurality of apertures and the suction pressure region when in the second position. The first scroll member may define a first passage extending through the first end plate and in communication with the first chamber and the discharge passage, a second passage extending through the first end plate from the first chamber to an outer surface of the first scroll member and a third passage extending through the end plate from the first chamber to a suction pressure region of the compressor.

The piston may isolate the first and second passages from communication with the first aperture and the third passage when in the first and second positions. The piston may prevent communication between the first aperture and the third passage when in the first position, and the piston may provide communication between the first aperture and the third passage when in the second position. The compressor may additionally include a valve assembly in communication with the second passage to selectively vent the second passage to the suction pressure region of the compressor and displace the piston between the first and second positions. The compressor may operate at the full capacity when the piston is in the first position. The valve assembly may be adapted to cycle the piston between the first and second positions to provide a compressor operating capacity between zero capacity and full capacity. The first passage may be in communication with the discharge passage when the piston is in the first and second positions. The first passage may have a greater flow restriction than the second passage. The discharge passage may be in communication with the suction pressure region when the second passage is vented to the suction pressure region.

The compressor may additionally include a floating seal engaged with the first scroll member and defining a second chamber. The piston may be located axially between the floating seal and the pockets. The first chamber may include an annular chamber and the piston may include an annular piston.

The compressor may additionally include a biasing member engaged with the first scroll member and axially biasing the first scroll member into engagement with the second scroll member during the reduced capacity mode. The compressor may additionally include a valve assembly selectively controlling communication between the first aperture and the suction pressure region of the compressor. The valve assembly may cycle communication between the first aperture and the suction pressure region to provide compressor operation at a capacity between full capacity and zero capacity.

In another arrangement, a compressor may include a housing, a non-orbiting scroll member, an orbiting scroll member, a seal and a modulation assembly. The non-orbiting scroll member may be supported within the housing and may include a first end plate having a discharge passage, a first spiral wrap extending from a first side of the first end plate, and a plurality of apertures extending through the first end plate. The orbiting scroll member may be supported within the housing and may include a second end plate having a second spiral wrap extending therefrom and meshingly engaged with the first spiral wrap to form a suction pocket, a discharge pocket and intermediate pockets during orbital displacement of the orbiting scroll member relative to the non-orbiting scroll member. The plurality of apertures may be in communication with the intermediate pockets. The seal may be engaged with the housing and the non-orbiting scroll member. The non-orbiting scroll member may be axially displaceable relative to the orbiting scroll member while engaged with the seal. The modulation assembly may be located within the housing and may be in communication with the plurality of apertures. The modulation assembly may be operable in a full capacity mode where the plurality of apertures are isolated from a suction pressure region of the compressor to operate the compressor at a full capacity during orbital displacement of the orbiting scroll member relative to the non-orbiting scroll member and in a reduced capacity mode where the intermediate pockets are in communication with the suction pressure region via the plurality of apertures to operate the compressor at approximately zero capacity during orbital displacement of the orbiting scroll member relative to the non-orbiting scroll member.

An axial end surface of the non-orbiting scroll member may abut the orbiting scroll member during a reduced capacity mode. The compressor may additionally include a valve assembly selectively controlling communication between the plurality of apertures and the suction pressure region of the compressor. The valve assembly may cycle communication between the plurality of apertures and the suction pressure region to provide compressor operation at a capacity between full capacity and zero capacity.

In another arrangement, a compressor may include a housing, a first scroll member, a second scroll member and a modulation assembly. The first scroll member may be supported within the housing and may include a first end plate having a discharge passage, a first spiral wrap extending from a first side of the first end plate, and a first aperture extending through the first end plate. The second scroll member may be supported within the housing and may include a second end plate having a second spiral wrap extending therefrom and meshingly engaged with the first spiral wrap to form a series of pockets during orbital displacement of the second scroll member relative to the first scroll member. The first aperture may be in communication with a first of the pockets. The modulation assembly may be located within the housing and may be in communication with the first aperture. The modulation assembly may be operable in a full capacity mode where the first aperture is isolated from a suction pressure region of the compressor to operate the compressor at a full capacity during orbital displacement of the second scroll member relative to the first scroll member and in a reduced capacity mode where the first aperture is in communication with the suction pressure region to operate the compressor at approximately zero capacity during orbital displacement of the second scroll member relative to the first scroll member while the pockets are isolated from one another between the first and second end plates by the first and second spiral wraps.

The compressor may additionally include a valve assembly selectively controlling communication between the plurality of apertures and the suction pressure region of the compressor. The valve assembly may cycle communication between the plurality of apertures and the suction pressure region to provide compressor operation at a capacity between full capacity and zero capacity. The series of pockets may include a suction pocket, a discharge pocket and intermediate pockets. The first end plate may define a plurality of apertures including the first aperture and in communication with the intermediate pockets. Each of the intermediate pockets may be in communication with one of the apertures. The reduced capacity mode may include each of the apertures being in communication with the suction pressure region to provide compressor operation at approximately zero capacity.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
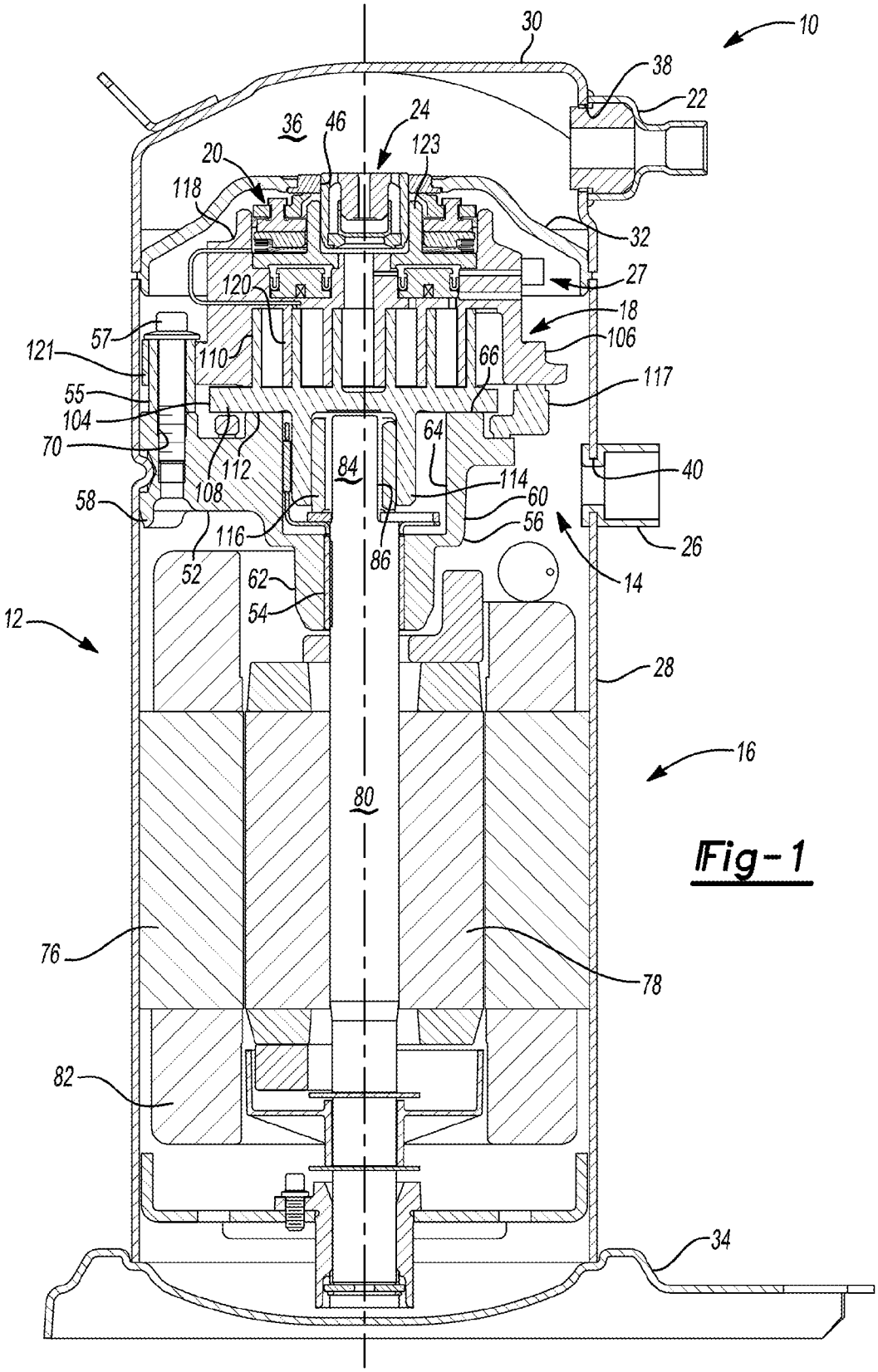
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may form a compressor housing and may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Suction gas inlet fitting 26 may be attached to shell assembly 12 at opening 40. Partition 32 may include a discharge passage 46 therethrough having discharge valve assembly 24 fixed thereto to provide communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arm 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 117 may be engaged with the orbiting and non-orbiting scrolls 104, 106 to prevent relative rotation therebetween.

Figure 2:
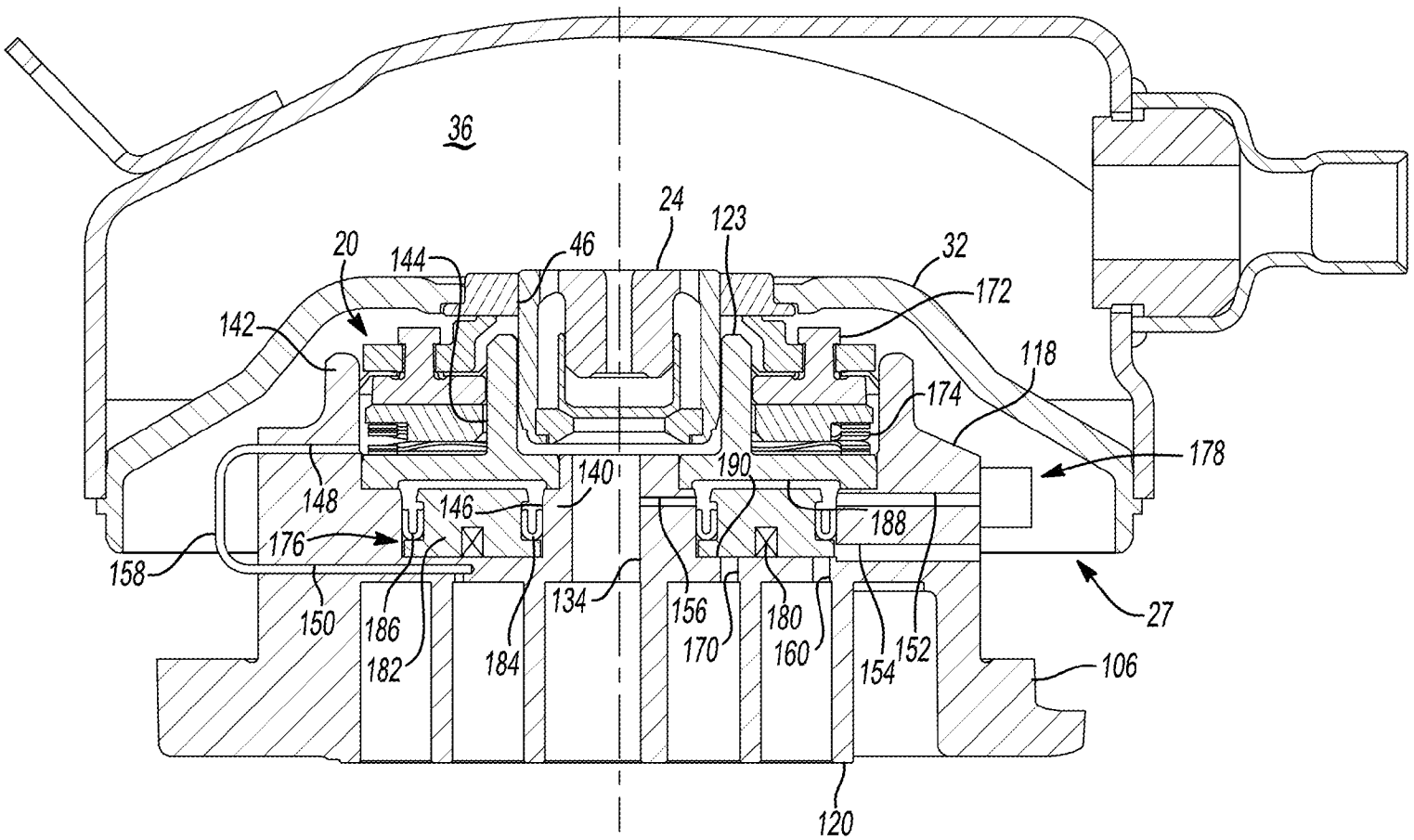
FIG. 2 is a section view of a non-orbiting scroll, seal assembly, and modulation system of the compressor of FIG. 1.
Figure 3:
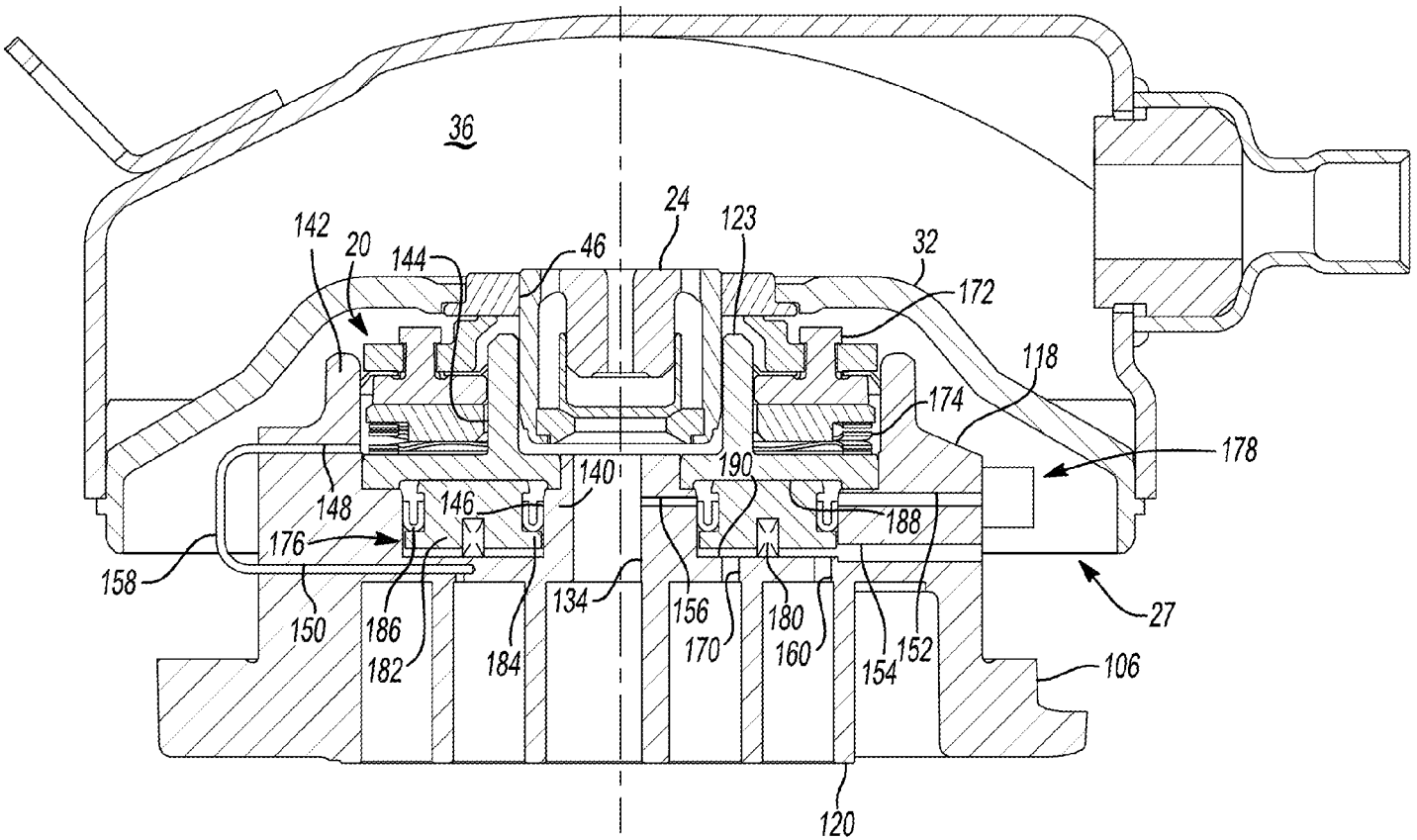
FIG. 3 is an additional section view of the non-orbiting scroll, seal assembly, and modulation system of FIG. 2.
Figure 4:
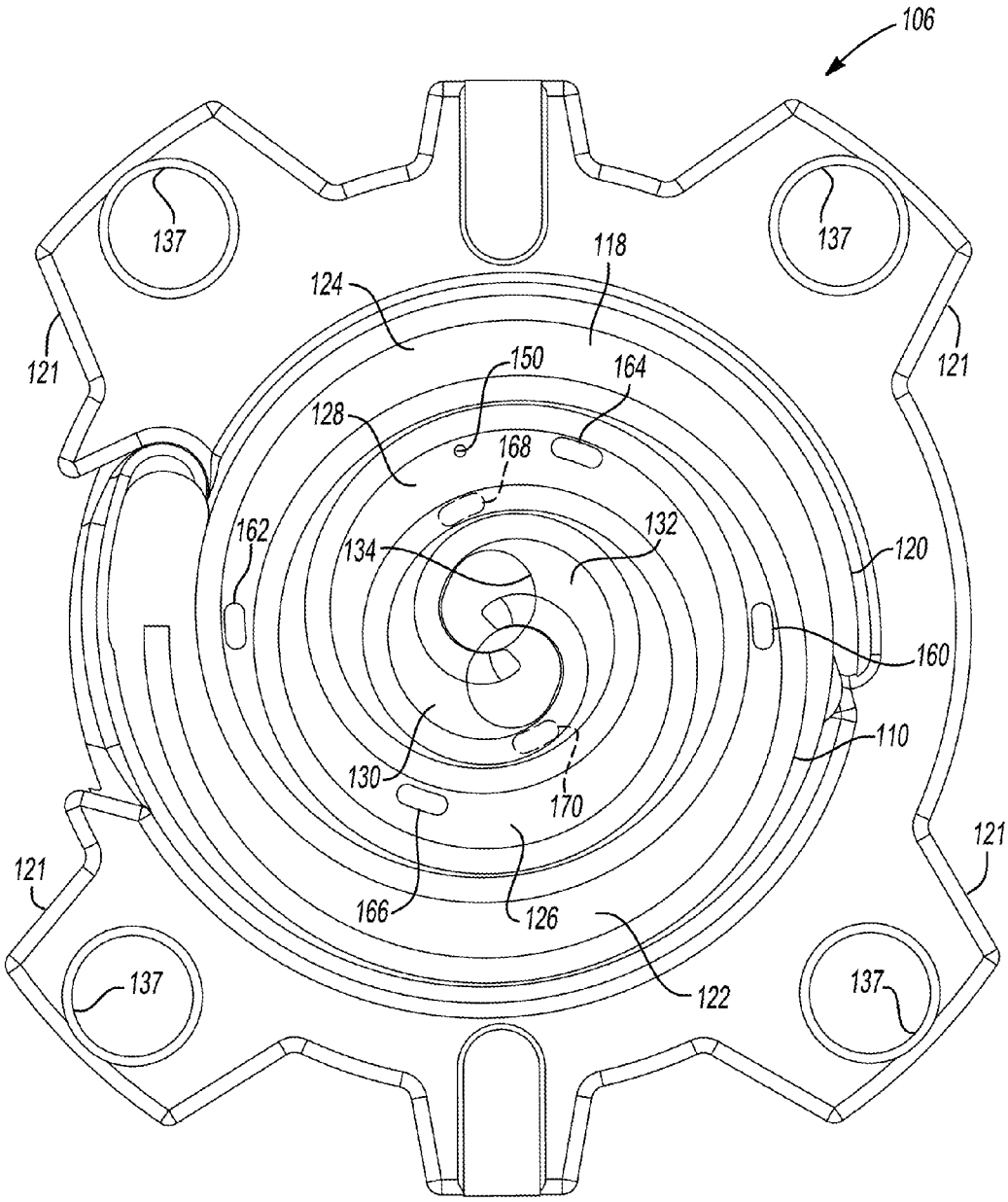
FIG. 4 is a plan view of a non-orbiting scroll of the compressor of FIG. 1.

With additional reference to FIGS. 2-4, non-orbiting scroll 106 may include an end plate 118 having a spiral wrap 120 on a lower surface thereof, a series of radially outwardly extending flanged portions 121, and an annular hub 123. Spiral wrap 120 may form a meshing engagement with wrap 110 of orbiting scroll 104, thereby creating a series of pockets 122, 124, 126, 128, 130, 132. Non-orbiting scroll 106 may be axially displaceable relative to main bearing housing assembly 14, shell assembly 12, and orbiting scroll 104. Non-orbiting scroll 106 may include a discharge passage 134 in communication with pocket 130, 132 and in fluid communication with discharge chamber 36 via discharge valve assembly 24.

Flanged portions 121 may include openings 137 therethrough. Openings 137 may receive bushings 55 therein and bushings 55 may receive fasteners 57. Fasteners 57 may be engaged with main bearing housing 52 and bushings 55 may generally form a guide for axial displacement of non-orbiting scroll 106. Fasteners 57 may additionally prevent rotation of non-orbiting scroll 106 relative to main bearing housing assembly 14.

End plate 118 may include parallel coaxial inner and outer side walls 140, 142. Annular hub 123 may be fixed to end plate 118 and may cooperate with end plate 118 and seal assembly 20 to form first and second annular chambers 144, 146. Discharge valve assembly 24 may be fixed within discharge passage 46 to prevent a reverse flow condition through compression mechanism 18. End plate 118 may include first, second, third, fourth and fifth passages 148, 150, 152, 154, 156. First passage 148 may extend radially outwardly from first annular chamber 144 to an outer radial surface of non-orbiting scroll 106. Second passage 150 may be in communication with pocket 128 and may extend radially outwardly to an outer radial surface of non-orbiting scroll 106. A conduit 158 may extend from first passage 148 to second passage 150 to provide communication between pocket 128 and first annular chamber 144. Third and fourth passages 152, 154 may each extend radially outwardly from second annular chamber 146 to an outer radial surface of non-orbiting scroll 106. Fifth passage 156 may extend radially inwardly from second annular chamber 146 to discharge passage 134 of non-orbiting scroll 106 and may have a greater restriction than third passage 152. For example, fifth passage 156 may have a smaller diameter than third passage 152.

First and second annular chambers 144, 146 may be isolated from one another. First annular chamber 144 may provide for axial biasing of non-orbiting scroll 106 relative to orbiting scroll 104 and second annular chamber 146 may cooperate with modulation assembly 27 to adjust capacity of compressor 10, as discussed below. Apertures 160, 162, 164, 166, 168, 170 may extend through end plate 118, placing second annular chamber 146 in communication with pockets 122, 124, 126, 128 during compressor operation, while allowing isolation of pockets 130, 132 from second annular chamber 146.

Seal assembly 20 may include a floating seal 172 and a biasing member 174, such as a compression spring, located within first annular chamber 144. Floating seal 172 may be axially displaceable relative to non-orbiting scroll 106 to provide for axial displacement of non-orbiting scroll 106 while maintaining a sealed engagement with partition 32 to isolate discharge and suction pressure regions of compressor 10 from one another. More specifically, pressure within first annular chamber 144 may bias floating seal 172 into engagement with partition 32 during normal compressor operation. Biasing member 174 may provide an additional force urging floating seal 172 into engagement with partition 32.

Modulation assembly 27 may include a piston assembly 176, a valve assembly 178, and a biasing member 180. The piston assembly 176 may include an annular piston 182 and first and second annular seals 184, 186. Annular piston 182 may be located in second annular chamber 146 and first and second annular seals 184, 186 may be engaged with inner and outer side walls 140, 142 to separate second annular chamber 146 into first and second portions 188, 190 that are isolated from one another. First portion 188 may be in communication with third and fifth passages 152, 156 and second portion 190 may be in communication with fourth passage 154. Valve assembly 178 may selectively vent third passage 152, and therefore first portion 188 to suction pressure. The smaller diameter of fifth passage 156 generally prevents pressure build-up in first portion 188 when valve assembly 178 vents first portion 188 to suction pressure. Biasing member 180 may include a spring and may be located in second portion 190 and engaged with annular piston 182.

Annular piston 182 may be displaceable between first and second positions. In the first position (FIG. 2), annular piston 182 may seal apertures 160, 162, 164, 166, 168, 170 from communication with second portion 190 of second annular chamber 146. The first position may generally correspond to a full capacity mode of compressor 10. In the second position (FIG. 3), annular piston 162 may be displaced from apertures 160, 162, 164, 166, 168, 170, providing communication between apertures 160, 162, 164, 166, 168, 170 and second portion 190 of second annular chamber 146. Therefore, when annular piston 182 is in the second position, apertures 160, 162, 164, 166, 168, 170 may be in communication with a suction pressure region of compressor 10 via fourth passage 154.

The second position may generally correspond to a reduced capacity mode of compressor 10. The reduced capacity mode may include compressor operation at a capacity of approximately zero. During the reduced capacity mode, each of pockets 122, 124, 126, 128 may be vented to the suction pressure region of compressor 10. A small amount of compression may remain from pockets 130, 132. However, the compression from pockets 130, 132 may be vented to the suction pressure region through valve assembly 178.

The reduced capacity mode may further include an intermediate capacity where compressor 10 operates at a capacity between zero and full capacity. The intermediate capacity may be achieved by cycling displacement of annular piston 182 between the first and second positions by cycling the valve assembly 178 between first and second positions. The duty cycle may be determined as the fraction of time that annular piston 182 is in the open position. Capacity modulation may be accomplished in any manner known in the art, including pulse-width modulation wherein the pulse width is modulated to vary the average value of the control signal waveform.

Discharge valve assembly 24 may prevent a reverse flow from discharge chamber 36 to compression mechanism 18 during reduced capacity operation of compressor 10. Fixing discharge valve assembly 24 to partition 32 may reduce the axial force applied to non-orbiting scroll 106, particularly during a low- or zero-capacity mode.

Fifth passage 156 may continuously be in communication with discharge pressure from discharge passage 134. When valve assembly 178 is in the closed position, pressure within first portion 188 of second annular chamber 146 may maintain annular piston 182 in the first position. When valve assembly 178 is in the open position, first portion 188 of second annular chamber 146 may be in communication with the suction pressure region of compressor 10. Fifth passage 156 may therefore also be in communication with suction pressure. Biasing member 180 may urge annular piston 182 to the second position providing communication between apertures 160, 162, 164, 166, 168, 170 and suction pressure. Annular piston 182 may be returned to the first position by closing valve assembly 178. The compression provided by pockets 130, 132 may provide a pressure to first portion 188 of second annular chamber 146 when valve assembly 178 is closed to return annular piston 182 to the first position.

When annular piston 182 is in the first position (FIG. 2), non-orbiting scroll 106 may be biased axially against and engaged with orbiting scroll 104 by the pressure within first annular chamber 144 from pocket 128 as well as by biasing member 174 acting on floating seal 172 and non-orbiting scroll 106. When annular piston 182 is in the second position (FIG. 3), non-orbiting scroll 106 may no longer be biased against orbiting scroll 104 by the pressure within first annular chamber 144 from pocket 128 since pocket 128 is in communication with suction pressure. However, biasing member 174 may continue to act on floating seal 172 and non-orbiting scroll 106 to axially bias non-orbiting scroll 106 against and into engagement with orbiting scroll 104 and to axially bias floating seal 172 into engagement with partition 32.

Therefore, non-orbiting scroll 106 may contact orbiting scroll 104 when annular piston 182 is in the first and second positions and floating seal 172 may remain in sealing engagement with partition 32 to isolate the suction pressure region from discharge passage 134. More specifically, an axial end surface of non-orbiting scroll 106 may contact orbiting scroll 104 and an axial end surface of orbiting scroll 104 may contact non-orbiting scroll 106 when annular piston 182 is in both the first and second positions. For example, wrap 110 of orbiting scroll 104 may contact end plate 118 of non-orbiting scroll 106 and wrap 120 of non-orbiting scroll 106 may contact end plate 108 of orbiting scroll 104. Thus, the orbiting and non-orbiting scrolls 104, 106 may axially contact one another when compressor 10 is operated at the full capacity mode as well as when compressor 10 is operated at approximately zero capacity, or at any reduced capacity between full and zero capacity.

The terms "first", "second", etc. are used throughout the description for clarity only and are not intended to limit similar terms in the claims.

What is claimed is:

1. A compressor comprising:

a housing;

a first scroll member having a first axial end surface, supported within said housing and including a first end plate having a discharge passage, a first spiral wrap extending from a first side of said first end plate and a first aperture extending through said first end plate;

a second scroll member having a second axial end surface, supported within said housing and including a second end plate having a second spiral wrap extending therefrom, said first and second spiral wraps meshingly engaged and forming a series of pockets during orbital displacement of the second scroll member relative to the first scroll member, said first aperture being in communication with a first of said pockets; and a modulation assembly located within said housing and including an annular piston, said modulation assembly operable in a full capacity mode with said annular piston isolating said first aperture from a suction pressure region of the compressor to operate the compressor at a full capacity during orbital displacement of said second scroll member relative to said first scroll member and operable in a reduced capacity mode with said annular piston permitting said first aperture to be in communication with said suction pressure region to operate the compressor at approximately zero capacity during orbital displacement of said second scroll member relative to said first scroll member while said first axial end surface contacts said second scroll member or said second axial end surface contacts said first scroll member.

2. The compressor of claim 1, wherein said series of pockets includes a suction pocket, a discharge pocket and intermediate pockets and said first end plate defines a plurality of apertures including said first aperture and in communication with said intermediate pockets.

3. The compressor of claim 2, wherein each of said intermediate pockets is in communication with one of said apertures.

4. The compressor of claim 3, wherein the reduced capacity mode includes each of said apertures being in communication with said suction pressure region to provide compressor operation at approximately zero capacity.

5. The compressor of claim 2, further comprising an annular chamber located on a second side of said first end plate and in communication with said plurality of apertures, said annular piston axially displaceable between first and second positions, said annular piston isolating said plurality of apertures from communication with said suction pressure region when in the first position and providing communication between said plurality of apertures and said suction pressure region when in the second position.

6. The compressor of claim 5, wherein said first scroll member defines a first passage extending through said first end plate and in communication with said annular chamber and said discharge passage, a second passage extending through said first end plate from said annular chamber to an outer surface of said first scroll member and a third passage extending through said first end plate from said annular chamber to a suction pressure region of the compressor.

7. The compressor of claim 6, wherein said annular piston isolates said first and second passages from communication with said first aperture and said third passage when in the first and second positions, said annular piston preventing communication between said first aperture and said third passage when in the first position, and said annular piston providing communication between said first aperture and said third passage when in the second position.

8. The compressor of claim 6, further comprising a valve assembly in communication with said second passage to selectively vent said second passage to said suction pressure region of the compressor and displace said annular piston between the first and second positions.

9. The compressor of claim 8, wherein the compressor operates at the full capacity when said annular piston is in the first position, said valve assembly adapted to cycle said annular piston between the first and second positions to provide a compressor operating capacity between zero capacity and full capacity.

10. The compressor of claim 6, wherein said first passage is in communication with said discharge passage when said annular piston is in the first and second positions.

11. The compressor of claim 6, wherein said first passage has a greater flow restriction than said second passage.

12. The compressor of claim 6, wherein said discharge passage is in communication with said suction pressure region when said second passage is vented to said suction pressure region.

13. The compressor of claim 5, further comprising a floating seal engaged with said first scroll member and defining a second chamber.

14. The compressor of claim 13, wherein said annular piston is located axially between said floating seal and said pockets.

15. The compressor of claim 1, further comprising a biasing member engaged with said first scroll member and axially biasing said first scroll member into engagement with said second scroll member during the reduced capacity mode.

16. The compressor of claim 1, further comprising a valve assembly selectively controlling communication between said first aperture and said suction pressure region of the compressor, said valve assembly cycling communication between said first aperture and said suction pressure region to provide compressor operation at a capacity between full capacity and zero capacity.

17. The compressor of claim 1, wherein said first spiral wrap contacts said second end plate during orbital displacement of said second scroll member relative to said first scroll member and compressor operation at approximately zero capacity.

18. The compressor of claim 1, wherein said second spiral wrap contacts said first end plate during orbital displacement of said second scroll member relative to said first scroll member and compressor operation at approximately zero capacity.

19. The compressor of claim 1, wherein said modulation assembly includes a biasing member that biases said annular piston toward one of said first position and said second position.

20. A compressor comprising:

a housing;

a non-orbiting scroll member supported within said housing and including a first end plate having a discharge passage, a first spiral wrap extending from a first side of said first end plate, and a plurality of apertures extending through said first end plate;

an orbiting scroll member supported within said housing and including a second end plate having a second spiral wrap extending therefrom and meshingly engaged with said first spiral wrap to form a suction pocket, a discharge pocket and intermediate pockets during orbital displacement of said orbiting scroll member relative to said non-orbiting scroll member, said plurality of apertures being in communication with said intermediate pockets; and a modulation assembly located within said housing and including a piston, said modulation assembly operable in a full capacity mode where said piston isolates more than one of said plurality of apertures from a suction pressure region of the compressor to operate the compressor at a full capacity during orbital displacement of said orbiting scroll member relative to said non-orbiting scroll member and operable in a reduced capacity mode where said piston permits said intermediate pockets to be in communication with said suction pressure region via more than one of said plurality of apertures to operate the compressor at approximately zero capacity during orbital displacement of said orbiting scroll member relative to said non-orbiting scroll member.

21. The compressor of claim 20, further comprising a seal engaged with said housing and said non-orbiting scroll member, said non-orbiting scroll member being axially displaceable relative to said orbiting scroll member while engaged with said seal.

22. The compressor of claim 20, wherein an axial end surface of said non-orbiting scroll member contacts said orbiting scroll member during the reduced capacity mode.

23. The compressor of claim 20, further comprising a valve assembly selectively controlling communication between said plurality of apertures and said suction pressure region of the compressor, said valve assembly cycling communication between said plurality of apertures and said suction pressure region to provide compressor operation at a capacity between full capacity and zero capacity.

24. A compressor comprising:

a housing;

a first scroll member supported within said housing and including a first end plate having a discharge passage, a first spiral wrap extending from a first side of said first end plate, and a first aperture extending through said first end plate;

a second scroll member supported within said housing and including a second end plate having a second spiral wrap extending therefrom and meshingly engaged with said first spiral wrap to form a series of pockets during orbital displacement of said second scroll member relative to said first scroll member, said first aperture being in communication with a first of said pockets; and a modulation assembly located within said housing and including an annular piston, said modulation assembly operable in a full capacity mode during orbital displacement of said second scroll member relative to said first scroll member with said annular piston isolating said first aperture from a suction pressure region of the compressor to operate the compressor at a full capacity and operable in a reduced capacity mode during orbital displacement of said second scroll member relative to said first scroll member with said annular piston permitting said first aperture to be in communication with said suction pressure region to operate the compressor at approximately zero capacity while said pockets are isolated from one another between said first and second end plates by said first and second spiral wraps.

25. The compressor of claim 24, further comprising a valve assembly selectively controlling communication between said first aperture and said suction pressure region of the compressor, said valve assembly cycling communication between said first aperture and said suction pressure region to provide compressor operation at a capacity between full capacity and zero capacity.

26. The compressor of claim 24, wherein said series of pockets includes a suction pocket, a discharge pocket and intermediate pockets and said first end plate defines a plurality of apertures including said first aperture and in communication with said intermediate pockets.

27. The compressor of claim 26, wherein each of said intermediate pockets is in communication with one of said apertures.

28. The compressor of claim 27, wherein the reduced capacity mode includes each of said apertures being in communication with said suction pressure region to provide compressor operation at approximately zero capacity.

* * * * *